US006143365A

United States Patent [19]

Ahmed

[11] Patent Number: 6,143,365

[45] Date of Patent: Nov. 7, 2000

[54] AUTODEPOSITED COATING WITH IMPROVED THERMAL STABILITY AND COMPOSITION AND PROCESS THEREFOR

[75] Inventor: Bashir M. Ahmed, Utica, Mich.

[73] Assignee: Henkel Corporation, Gulph Mills, Pa.

[21] Appl. No.: 09/325,590

[22] Filed: Jun. 3, 1999

Related U.S. Application Data

[60] Provisional application No. 60/087,983, Jun. 3, 1998.

[51] Int. Cl.[7] ..... B05D 3/10

[52] U.S. Cl. ..... 427/341; 427/352; 427/388.2; 427/388.4; 427/435

[58] Field of Search ..... 427/435, 340, 427/341, 352, 388.2, 388.4

[56] References Cited

U.S. PATENT DOCUMENTS 3,647,567 3/1972 Schweri ..... 148/6.15 R
4,874,673 10/1989 Donovan et al. ..... 427/437
5,248,525 9/1993 Siebert ..... 427/337
5,352,726 10/1994 Hall ..... 524/435

*Primary Examiner*—Katherine A. Bareford
*Attorney, Agent, or Firm*—Wayne C. Jaeschke; Stephen D. Harper; Norvell E. Wisdom, Jr.

[57] ABSTRACT

The susceptibility to heat degradation of an autodeposited coating in which the principal organic constituents are copolymers of vinylidene chloride in which vinylidene chloride residues constitute at least half the weight of the total binder phase in the autodeposited coating is improved if the wet autodeposited coatings are rinsed, before being later dried and cured, with a water-based liquid rinse that comprises dissolved phosphate ions in a concentration that corresponds stoichiometrically to at least 0.5 g/l of tripolyphosphate ions. The water-based liquid rinse preferably has a strongly alkaline pH and also comprises dissolved organic molecules that are effective chelating agents for dissolved iron cations by reason of having in each molecule at least two carboxyl, carboxylate, and/or other hydroxy moieties.

12 Claims, No Drawings

AUTODEPOSITED COATING WITH IMPROVED THERMAL STABILITY AND COMPOSITION AND PROCESS THEREFOR

CROSS-REFERENCE TO RELATED APPLICATIONS

Priority is claimed under 35 U.S.C. § 119(e) from application Ser. No. 60/087,983 filed Jun. 3, 1998.

STATEMENT REGARDING FEDERALLY SPONSORED RESEARCH OR DEVELOPMENT

Not applicable.

BACKGROUND OF THE INVENTION

This invention relates to the use of autodepositing aqueous liquid compositions that are both dispersions and solutions in water. By mere contact with these autodepositing liquid compositions, active metal surfaces can be coated with an adherent polymer film that increases in thickness the longer the time of contact, even though the aqueous liquid composition is stable for a long time against spontaneous precipitation or flocculation of any solid phase, in the absence of contact with active metal. (For the purposes of this specification, the term "active metal" is to be understood in its broadest sense as including all metals and alloys more active than hydrogen in the electromotive series, or, in other words, a metal is which is thermodynamically capable of dissolving to produce dissolved cations derived from the metal, with accompanying evolution of hydrogen gas, when contacted with an aqueous solution of a non-oxidizing acid in which the activity of hydrogen ions is 1.00 equivalent per liter.) Such liquid compositions are denoted in this specification, and commonly in the art, as "autodeposition" or "autodepositing" compositions, dispersions, emulsions, suspensions, baths, solutions, or a like term. Autodeposition is often contrasted with electrodeposition, which can produce very similar adherent films but requires that the surface to be coated be connected to a source of direct current electricity for coating to occur.

More particularly, this invention relates to autodeposition in which the adherent polymer film that forms includes as its predominant organic constituent polymers that include substantial amounts of chlorine atoms, as more specifically detailed in U.S. Pat. No. 5,352,726 of Oct. 4, 1994 to Hall, the entire disclosure of which, except to any extent that it may be contrary to any explicit statement herein, is hereby incorporated herein by reference.

The coating formed while a metal substrate is immersed in an autodeposition bath is wet and fairly weak, although sufficiently strong to maintain itself against gravity and moderate spraying forces. In this state the coating is described as "uncured". To make an autodeposition coated object suitable for normal practical use, the uncured coating is dried, usually with the aid of heat. The coating is then described as "cured".

The present invention relates more particularly to the chemical treatment of an uncured autodeposited coating for the purpose of improving various properties of the cured coating that is subsequently formed from the uncured coating. Most particularly, a major object of this invention is to increase the thermal stability of the chlorine containing polymer coatings formed. It is generally known that polymers of vinylidene chloride, residues of which are the predominant component of a coating resin used in the type of autodeposition bath toward which this invention is directed, have relatively poor thermal stability compared with most other common commercial polymers. One readily noted evidence of this thermal instability is the darkening of the polymers when exposed to heat, and the darkening is normally is well correlated with less overt losses of mechanical strength and resistance to chemical reactions that can severely limit the practical uses of polymers that undergo them. Various additives are known in the general polymer art for increasing the stability of polymers of vinylidene chloride, but all of those tried have been found to impart other unacceptable characteristics to autodeposition baths into which they have been incorporated.

Except in the claims and the operating examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred, however. Also, throughout the description, unless expressly stated to the contrary: percent, "parts of", and ratio values are by weight or mass; the term "polymer" includes "oligomer", "copolymer", "terpolymer" and the like; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description or of generation in situ within the composition by chemical reaction(s) noted in the specification between one or more newly added constituents and one or more constituents already present in the composition when the other constituents are added, and does not necessarily preclude unspecified chemical interactions among the constituents of a mixture once mixed; specification of constituents in ionic form additionally implies the presence of sufficient counterions to produce electrical neutrality for the composition as a whole and for any substance added to the composition; any counterions thus implicitly specified preferably are selected from among other constituents explicitly specified in ionic form, to the extent possible; otherwise such counterions may be freely selected, except for avoiding counterions that act adversely to an object of the invention; the word "mole" means "gram mole", and the word itself and all of its grammatical variations may be used for any chemical species defined by all of the types and numbers of atoms present in it, irrespective of whether the species is ionic, neutral, unstable, hypothetical, or in fact a stable neutral substance with well defined molecules; and the terms "solution", "soluble", "homogeneous", and the like are to be understood as including not only true equilibrium solutions or homogeneity but also dispersions that show no visually detectable tendency toward phase separation over a period of observation of at least 100, or preferably at least 1000, hours during which the material is mechanically undisturbed and the temperature of the material is maintained within the range of 18–25° C.

BRIEF SUMMARY OF THE INVENTION

It has been found that the thermal discoloration of coatings of polymers of vinylidene chloride formed by autodeposition can be greatly reduced by contacting the wet uncured coatings formed by such an autodeposition bath with a strongly alkaline aqueous composition that contains phosphate ions and preferably also another chelating agent for iron cations. Furthermore, the impact resistance of the coatings is usually substantially increased by the same treatment.

DETAILED DESCRIPTION OF THE INVENTION

A composition according to the invention for contacting a wet autodeposited coating comprises, preferably consists essentially of, or more preferably consists of water and the following components:

(A) a component of dissolved phosphate ions; and, optionally, one or more of the following components:

(B) a component of dissolved alkalinizing agents exclusive of phosphate ions;

(C) a component of chelating agents for iron cations that are not part of either of components (A) and (B) as described immediately above; and (D) a component of preservative molecules that are not part of any of components (A) through (C) as described immediately above.

A composition according to the invention preferably has a pH value that is at least, with increasing preference in the order given, 10.0, 10.5, 11.0, 11.2, 11.4, 11.6, 11.8, 12.0, 12.2, or 12.4 and independently, at least in part for economy, preferably is not more than, with increasing preference in the order given, 14, 13.5, 13.0, 12.8, or 12.6.

A composition according to the invention must contain dissolved phosphate anions. They may be supplied to the composition by any oxyacid of phosphorus, or water-soluble salt thereof, in which the phosphorus is in its +5 valence state, i.e., orthophosphoric acid, metaphosphoric acid, and the condensed phosphoric acids corresponding to the general formula $H_{(n+2)}P_nO_{(3n+1)}$, where n represents a positive integer with a value of at least 2. As is generally known in the art, these species are all believed to exist in equilibrium with one another, with the equilibrium strongly favoring orthophosphoric acid and/or its salts at low temperatures, concentrations, and pH values and favoring the more condensed acids, including metaphosphoric acid, and/or their salts at higher temperatures, concentrations, and pH values. For compositions according to this invention, tripolyphosphate salts are the preferred sources of the dissolved phosphate ions, with potassium and sodium salts, particularly the latter, being preferred primarily for economy. The concentration of phosphate ions in a working composition according to the invention, measured as the stoichiometric equivalent as tripolyphosphate ions of all sources of phosphate ions dissolved in the composition, irrespective of the actual concentrations of the various species in equilibrium with one another in the particular composition, preferably is at least, with increasing preference in the order given, 0.5, 0.8, 1.0, 1.5, 2.0, 2.5, 2.7, 2.9, 3.1, or 3.3 grams of tripolyphosphate ions (with the chemical formula $P_3O_{10}^5$) per liter of total working composition, this unit of concentration being generally applied hereinafter to any dissolved component in any composition and being abbreviated as "g/l", and independently preferably is not more than, with increasing preference in the order given, 30, 20, 15, 10, 8.0, 7.0, 6.0, 5.5, 5.0, 4.5, 4.0, 3.8, or 3.6 g/l.

Because the preferred amounts of phosphate ions do not generally by themselves provide sufficient alkalinity to achieve the preferred pH values in a working composition according to the invention, such a composition preferably also includes component (B) of additional alkalinizing material as described above. This preferably is selected from the group consisting of the sufficiently water soluble alkali and alkaline earth metal hydroxides and salts of very weak acids such as silicic and boric acids. At least for economy, hydroxides, preferably those of alkali metals, are preferably used. Independently of the particular alkalinizing agent(s) used, its or their concentration(s) preferably result in pH values for the total composition already within the pH value preferences stated above. For sodium hydroxide, usually the most preferred for economy, in the presence of preferred amounts of other components as described herein, this will generally be achieved by concentrations of 0.5 to 5.0, preferably 1.0 to 3.5, or more preferably 2.0 to 3.0, g/l of sodium hydroxide.

Although the anions of component (A) are believed to have some activity as chelating agents for iron cations, the presence of optional component (C) of additional chelating agents is generally preferred. These materials are preferably selected from the group of organic molecules each of which contains at least, with increasing preference in the order given, 2, 3, or 4 moieties selected from the group consisting of carboxyl and carboxylate moieties and hydroxyl moieties that are not part of carboxyl moieties. More preferably, each selected molecule includes at least one carboxylate moiety, which of course may be furnished to the highly alkaline composition according to the invention by dissolving a corresponding acid therein. Gluconic and citric acids and their salts are particularly preferred. Irrespective of the exact chemical nature of component (C), its concentration when used in a composition according to this invention preferably is at least, with increasing preference in the order given, 0.10, 0.30, 0.50, 0.70, 0.90, 1.10, or 1.20 millimoles of chelating agent molecules per liter of total composition, a concentration unit hereinafter usually abbreviated as "millimoles/l", and independently preferably, primarily for economy, is not more than, with increasing preference in the order given, 10, 8.0, 6.0, 4.0, 3.5, 3.0, 2.5, 2.0, 1.5, or 1.3 millimoles/l.

Component (C) is capable of nourishing some microorganisms that may be present in the ambient environment where a composition for use in this invention is used or stored. If growth of microorganisms in such a composition that does not contain optional preservative component (D) is observed, a suitable material should be added to prevent the growth. Preservatives containing isothiazolin-3-one moieties are particularly suitable; more preferably a mixture of the commercial products KATHON™ 886 MW and 893 MW preservatives from Rohm and Haas Co. is utilized. KATHON™ 886 MW is reported by its supplier to contain 10–12% of 5-chloro-2-methyl-isothiazolin-3-one and 3–5% of 2-methyl-isothiazolin-3-one as its preservative active ingredients along with 14–18% of magnesium nitrate and 8–10% of magnesium chloride, all in water solution with water as the balance, and to be particularly effective against bacteria. KATHON™ 893 MW is reported by its supplier to contain 45–48% of 2-n-octyl-4-isothiazolin-3-one and 52–55% of propylene glycol. Accordingly, a composition according to the invention in which a preservative is desired preferably contains, independently for each material noted, at least, with increasing preference in the order given: 0.50, 0.75, 0.90, 1.00, 1.10, 1.20, 1.30, or 1.37 parts per million by weight of the total composition, hereinafter usually abbreviated as "ppm", of 5-chloro-2-methyl-isothiazolin-3-one; 0.10, 0.20, 0.25, 0.30, 0.35, 0.40, 0.45, or 0.48 ppm of 2-methy-isothiazolin-3-one; and 0.75, 1.00, 1.50, 2.00, 2.25, 2.45, 2.60, 2.75, or 2.90 ppm of 2-n-octyl-isothiazolin-3-one. Also, independently of other preferences and independently for each material noted, a composition according to the invention preferably contains not more than, with increasing preference in the order given: 10, 8, 6, 4.0, 3.0, 2.5, 2.0 or 1.5 ppm of 5-chloro-2-methyl-isothiazolin-3-one; 5, 3, 2.0, 1.5, 1.0, 0.8, 0.6, or 0.54 ppm of 2-methyl-isothiazolin-3-one; and 25, 15, 10, 8, 6, 5.0, 4.0, 3.7, 3.4, 3.2, or 3.0 ppm of 2-n-octyl-isothiazolin-3-one, all of the preferences stated in this sentence being primarily for economy.

A process according to the invention comprises at a minimum an operation of contacting a wet autodeposited coating containing polymers of vinyl chloride and/or vinylidene chloride as its predominant organic constituent with a composition according to the invention as described above, the contact being maintained for a sufficient time to cause the cured coating that eventually results from the thus contacted wet coating to manifest greater resistance against discoloration when heated in the nature ambient atmosphere than does an Otherwise identical coating made by a process in which the composition according to this invention is substituted by deionized or similarly purified water. The contact may be established by any method such as spraying, immersion, curtain coating, or the like, but in view of the ease of mechanically damaging the wet autodeposited coating, immersion is usually preferred because it is less likely to cause mechanical damage than any other method of establishing contact. During the immersion, a relative velocity of no more than a few centimeters per second between the substrate and the liquid in which it is immersed is preferably maintained, in order to mix the volume of the liquid in immediate proximity to the wet autodeposited coating with the bulk of the liquid in which the coating is immersed. When contact is by immersion, the time of contact preferably is at least, with increasing preference in the order given, 10, 20, 30, 40, 50, or 55 seconds and independently, primarily for economy, preferably is not more than, with increasing preference in the order given, 600, 400, 300, 200, 100, 80, 70, or 60 seconds. Also, independently of the contact method and time, the temperature of a composition according to the invention during its contact with a wet autodeposited coating preferably is at least, with increasing preference in the order given, 18, 20, or 22° C. and independently preferably is not more than, with increasing preference in the order given, 30, 28, or 26° C.

A wet autodeposited coating to be treated in a process according to the invention preferably should be dried as little as is reasonably possible before being contacted with a composition according to the invention. Therefore, if the wet coating is, as is usual, exposed to the ambient atmosphere for at least a few seconds during its transfer from one location where the wet autodeposited coating is formed to another location where the coating thus formed is contacted with a composition according to the invention, the relative humidity of the ambient atmosphere preferably is at least, with increasing preference in the order given, 30, 35, 40, 45, 50, 55, 60, 65, 70, 75, or 80%.

A wet autodeposited coating that is to be treated in a process according to the invention may be and preferably is rinsed with water before being contacted with a composition according to this invention. Such a rinse, as for the contact with a composition according to the invention, may be carried out by any suitable method but is preferably by immersion and may satisfactorily utilize ordinary tap water. When contact between the rinse liquid and the wet autodeposited coating during this rinse is by immersion, the time of contact preferably is at least, with increasing preference in the order given, 10, 20, 30, 40, 50, or 55 seconds and independently, primarily for economy, preferably is not more than, with increasing preference in the order given, 600, 400, 300, 200, 100, 80, 70, or 60 seconds, and the temperature of the rinse liquid preferably is at least, with increasing preference in the order given, 18, 20, or 22° C. and independently preferably is not more than, with increasing preference in the order given, 30, 28, or 26° C.

After contact of a wet autodeposited coating with a composition according to this invention, the still wet coating as thus modified preferably is transferred as soon as reasonably possible into a higher temperature environment to begin curing. The curing temperature preferably is at least, with increasing preference in the order given, 40, 60, 70, 80, 90, or 97° C. and independently preferably is not more than, with increasing preference in the order given, 150, 140, 130, 120, 115, 110, 107, 105, 103, or 101° C., and the time of exposure to a curing temperature preferably is at least, with increasing preference in the order given, 1, 3, 5, 7, 8.0, 9.0, or 9.7 minutes and independently preferably is not more than, with increasing preference in the order given, 100, 50, 40, 30, 25, 23, 21, 19, 17, 15, 13, or 11 minutes.

For any part of a process according to the invention that includes other operations not specified above, adequate guidance as to preferred and satisfactory materials and conditions of use may be obtained from the prior autodeposition art.

The practice and benefits of the invention may be further appreciated by consideration of the following working and comparison examples.

Cold rolled steel test panels were subjected to the following process sequence in the order shown:

1. Clean by immersion for 2.0 minutes in a solution in water containing 7.4 g/l of AUTO-PHORETIC® Cleaner 1727, a commercially available product of the Henkel Surface Technologies Div. of Henkel Corp., Madison Heights, Mich., which is maintained during the immersion at a temperature of 71±2° C.
2. Remove from contact with the cleaning solution described in operation 1 and immerse for 1.0 minute in tap water maintained at a temperature within the range from 18–23° C.
3. Remove from contact with the tap water described in operation 2 and immerse for 1.0 minute in deionized water maintained at a temperature within the range from 18–23° C.
4. Remove from contact with the deionized water described in operation 3 and, while the surface is still wet, immerse for 1.0 minute in an autodepositing composition, with the ingredients shown in the table in column 20 of U.S. Pat. No. 5,352,726, except that the black pigment dispersion was omitted, the autodepositing composition being maintained at a temperature within the range from 18–23° C. during its contact with the substrate.
5. Remove the substrate, now bearing a wet autodeposited coating, from contact with the autodepositing composition described in operation 4 and immerse for 1.0 minute in tap water rinse liquid maintained at a temperature within the range from 18–23° C.
6. Remove the substrate, now bearing a rinsed wet autodeposited coating, from contact with the tap water rinse liquid described in operation 5 and immerse for 1.0 minute in a rinse liquid with a composition as specified further below, maintained at a temperature within the range from 18–23° C.
7. Remove the substrate, now bearing a treated rinsed autodeposited coating, from contact with the rinse liquid described in operation 6, and cure for 10.0 minutes in a forced air electric oven maintained at 100±2° C.

Compositions of the rinse liquids used in step 6 from the above process sequence are shown in Table 1 below.

The cured autodeposited coatings prepared in this manner were tested for thermal stability by exposure for 8.0 hours to air at 120±2° C. The results of these tests are shown in Table 2 below.

TABLE 1

COMPOSITIONS OF RINSE LIQUIDS USED

| Identifying Name or Number | Grams per Liter in Rinse Liquid of: $Na_5P_3O_{10}$ | Gluconic Acid | NaOH | $NH_4HCO_3$ |
|---|---|---|---|---|
| Control | — | — | — | 0.9 |
| 1 | 5.0 | — | — | — |
| 2 | 5.0 | 0.25 | — | — |
| 3 | 5.0 | 0.25 | 2.5 | — |

Note for Table 1
The balance not specified above for each rinse liquid was water. A hyphen entry indicates no addition of the material at the top of the column in which it occurs.

TABLE 2

RESULTS OF THE THERMAL STABILITY TESTS

| Identifying Name or Number | Test Results |
|---|---|
| Control | Coating was dark black, and panel failed a 0.30 kilogram-meter impact test. |
| 1 | Coating was brownish black, and panel barely passed a direct 0.30 kilogram-meter impact test. |
| 2 | Coating was less darkened than with rinse liquid 1, and panel passed a direct 0.30 kilogram-meter impact test but failed a reverse 0.30 kilogram-meter impact test. |
| 3 | Coating was less darkened than with rinse liquid 2, and panel passed both direct and reverse impact tests at 0.30, 1.2, and 1.5 kilogram-meter; at the latter value only, there was slight crazing in the reverse test only. |

The invention claimed is:

1. A process for forming an autodeposited coating with improved thermal stability on an active metal substrate, said process comprising operations of:

(I) contacting the active metal substrate with an autodepositing composition that comprises as its predominant coating resin a copolymer of vinylidene chloride, residues of vinylidene chloride constituting at least 50% by weight of the total weight of said copolymer, so as to form on the active metal substrate a wet adherent autodeposited coating;

(II) contacting the wet adherent autodeposited coating formed in operation (I) with a water-based liquid rinse comprising a concentration of tripolyphosphate ions that is at least about 0.5 g/l, so as to form a phosphate-rinsed wet adherent autodeposited coating; and (III) heating the phosphate-rinsed wet adherent autodeposited coating so as to convert it to a cured dry autodeposited coating.

2. A process according to claim 1, wherein said water-based liquid rinse has a pH value within a range from about 11.0 to about 13.5.

3. A process according to claim 2, wherein said water-based liquid rinse also comprises from about 0.30 to about 6.0 millimoles/l of molecules selected from the group consisting of dissolved organic molecules each of which contains at least 2 moieties selected from the group consisting of carboxyl moieties, carboxylate moieties, and hydroxyl moieties that are not part of carboxyl moieties.

4. A process according to claim 3, wherein said water-based liquid rinse has a pH value within a range from about 12.0 to about 13.0 and comprises:

from about 2.7 to about 4.5 g/l of tripolyphosphate ions; and from about 0.70 to about 2.0 millimoles/l of molecules selected from the group consisting of molecules each of which contains at least one carboxyl or carboxylate group and at least 3 other moieties selected from the group consisting of carboxyl, carboxylate, and hydroxy that is not part of carboxyl.

5. A process according to claim 1, wherein said water-based liquid rinse also comprises from about 0.30 to about 6.0 millimoles/l of molecules selected from the group consisting of organic molecules each of which contains at least 2 moieties selected from the group consisting of carboxyl moieties, carboxylate moieties, and hydroxyl moieties that are not part of carboxyl moieties.

6. A process according to claim 5, wherein said water-based liquid rinse has a pH value within a range from about 12.0 to about 13.0 and comprises:

from about 2.7 to about 4.5 g/l of tripolyphosphate ions; and from about 0.70 to about 2.0 millimoles/l of molecules selected from the group consisting of molecules each of which contains at least one carboxyl or carboxylate group and at least 3 other moieties selected from the group consisting of carboxyl, carboxylate, and hydroxy that is not part of carboxyl.

7. A process for forming an autodeposited coating with improved thermal stability on an active metal substrate, said process comprising operations of:

(I) contacting the active metal substrate with an autodepositing composition that has been made by mixing with water a stable dispersion in water of copolymer molecules of vinylidene chloride, residues of vinylidene chloride constituting at least about 50% by weight of the total weight of said copolymer molecules and said copolymer molecules together constituting at least about 50% by weight of all organic molecules in said autodepositing composition;

(II) contacting the wet adherent autodeposited coating formed in operation (I) with a water-based liquid rinse that has been made by mixing with a first mass of water at least a second mass of a water soluble salt of tripolyphosphoric acid, said second mass containing a sufficient quantity of tripolyphosphate ions to correspond to a concentration of tripolyphosphate ions that is at least about 0.5 g/l of the total water-based liquid rinse, so as to form a phosphate-rinsed wet adherent autodeposited coating; and (III) heating the phosphate-rinsed wet adherent autodeposited coating so as to convert it to a cured dry autodeposited coating.

8. A process according to claim 7, wherein said water-based liquid rinse has a pH value within a range from about 11.0 to about 13.5.

9. A process according to claim 8, wherein there has also been dissolved into said water-based liquid rinse a third mass of molecules selected from the group consisting of organic molecules each of which contains at least 2 moieties selected from the group consisting of carboxyl moieties, carboxylate moieties, and hydroxyl moieties that are not part of carboxyl moieties, said third mass constituting from about 0.30 to about 6.0 millimoles/l of said water-based liquid rinse.

10. A process according to claim 9, wherein:

said water-based liquid rinse has a pH value within a range from about 12.0 to about 13.0;

said second mass contains a mass of tripolyphosphate ions that constitutes from about 2.7 to about 4.5 grams per liter of said water-based liquid rinse; and said third mass constitutes from about 0.70 to about 2.0 millimoles, per liter of said water-based liquid rinse, of molecules selected from the group consisting of molecules each of which contains at least one carboxyl or carboxylate group and at least 3 other moieties selected from the group consisting of carboxyl, carboxylate, and hydroxy that is not part of carboxyl.

11. A process according to claim 7, wherein there has also been dissolved into said water-based liquid rinse a third mass of molecules selected from the group consisting of organic molecules each of which contains at least 2 moieties selected from the group consisting of carboxyl moieties, carboxylate moieties, and hydroxyl moieties that are not part of carboxyl moieties, said third mass constituting from about 0.30 to about 6.0 millimoles/l of said water-based liquid rinse.

12. A process according to claim 11, wherein:

said water-based liquid rinse has a pH value within a range from about 12.0 to about 13.0;

said second mass contains a mass of tripolyphosphate ions that constitutes from about 2.7 to about 4.5 grams per liter of said water-based liquid rinse; and said third mass constitutes from about 0.70 to about 2.0 millimoles, per liter of said water-based liquid rinse, of molecules selected from the group consisting of molecules each of which contains at least one carboxyl or carboxylate group and at least 3 other moieties selected from the group consisting of carboxyl, carboxylate, and hydroxy that is not part of carboxyl.

* * * * *